US005276295A

United States Patent [19]

Kameli

[11] Patent Number: 5,276,295

[45] Date of Patent: Jan. 4, 1994

[54] PREDICTOR ELEVATOR FOR TRAFFIC DURING PEAK CONDITIONS

[76] Inventor: Nader Kameli, 658 W. Main St., New Britain, Conn. 06053

[21] Appl. No.: 580,905

[22] Filed: Sep. 11, 1990

[51] Int. Cl.[5] ..... B66B 1/20

[52] U.S. Cl. ..... 187/132; 187/127; 187/131

[58] Field of Search ..... 187/125, 133, 132, 127, 187/131, 101, 100, 121, 124, 132

[56] References Cited

U.S. PATENT DOCUMENTS

| | | | |
|---|---|---|---|
| 3,561,571 | 2/1971 | Gingrich | 187/127 |
| 4,044,860 | 8/1977 | Kaneko et al. | 187/132 |
| 4,330,836 | 5/1982 | Donofrio et al. | 364/567 |
| 4,363,381 | 12/1982 | Bittar | 187/127 |
| 4,536,842 | 8/1985 | Yoneda et al. | 187/133 |
| 4,562,530 | 12/1985 | Umeda et al. | 187/100 |
| 4,672,531 | 6/1987 | Uetani | 187/124 |
| 4,815,568 | 3/1989 | Bittar | 187/127 |
| 4,846,311 | 7/1989 | Thangavelu | 187/125 |
| 4,926,976 | 5/1990 | Schroder | 187/125 |
| 5,024,296 | 6/1991 | Kameli | 187/132 |

*Primary Examiner*—Jeffrey A. Gaffin

[57] ABSTRACT

A computer controlled elevator system (FIG. 1) including signal processing means for dynamically computing the population spread or density of the buildings, i.e., the number of elevator users in a building on a floor-by-floor basis, including the lobby, and to use such information to compensate for traffic shifts occuring in connection with the up-peak period in which dynamic channeling is used for an elevator car assignment scheme based on prediction methodology, all in accordance with an algorithm (FIG. 3). If, for example, the prediction methodology predicts that the up-peak dynamic channeling scheme should begin but the real time data has not detected any beginnings of an up-peak traffic pattern, the prediction methodology is over-ridden until the real time data finally picks up such a pattern. Additionally, if the floor population spread which is derived from real time data indicates that one or more floors individually have received all of their expected floor population, those floors are devalued to a nominal "priority" basis of "1" in the dynamic channeling scheme, even though the prediction methodology predicts the arrival of additional people for those floor(s) in the remaining up-peak time set by the system. Thus, "too early start" (FIG. 2A) and "too late end" (FIG. 2B) of dynamic channeling are avoided.

3 Claims, 3 Drawing Sheets

Late Start Temporal Shift Pattern

Early Finish Temporal Shift Pattern

PREDICTOR ELEVATOR FOR TRAFFIC DURING PEAK CONDITIONS

REFERENCE TO RELATED APPLICATIONS

This application relates to some of the same subject matter as the co-pending patents/applications listed below owned by the assignee hereof, the disclosures of which are incorporated herein by reference:

Ser. No. 07/580,888 of the inventor hereof entitled "Behavior Based Cyclic Predictions for an Elevator System with Data Certainty Checks" filed on even date herewith and the applications cited therein including—

Ser. No. 07/508,312 of the inventor hereof entitled "Elevator Dynamic Channeling Dispatching for Up-Peak Period" filed on Apr. 12, 1990;

Ser. No. 07/508.313 of the inventor hereof entitled "Elevator Dynamic Channeling Dispatching Optimized Based on Car Capacity" filed on Apr. 12, 1990;

Ser. No. 07/508,318 of the inventor hereof entitled "Elevator Dynamic Channeling Dispatching Optimized Based on Population Density of the Channel" filed on Apr. 12, 1990;

U.S. Pat. No. 5,024,296 issued Jun. 18, 1991;

Ser. No. 07/580,887 of the inventor hereof entitled "Floor Population Detection for an Elevator System" also filed on even date herewith; as well as—

U.S. Pat. No. 5,022,497 issued Jun. 11, 1991; and

U.S. Pat. No. 5,035,302, issued Jul. 30, 1991.

TECHNICAL FIELD

The present invention relates to elevator systems and more particularly to computer controlled systems which use predictions of future traffic conditions based on past or historic data, as well as real time events, as a guide to, for example, assigning elevator cars to certain floors for "channeling" for the operation of the system during up-peak periods. More particularly, the present invention relates to the timing of when and how the historic and real time data are combined for making the predictions and even more particularly to techniques for compensating for significant traffic shifts which impact on a peak period, with the up-peak period being the particularly preferred application of the invention.

BACKGROUND ART

Dynamic channeling capability is an important feature in elevator systems to enhance system efficiency during up-peak periods. For further background information, note, for example, U.S. Pat. No. 4,846,311 of Kandasamy Thangavelu entitled "Optimized 'Up-Peak' Elevator Channeling System with Predicted Traffic Volume Equalized Sector Assignments" of Otis Elevator Company, the assignee hereof, the disclosure of which is incorporated herein by reference, as well as others of assignee's patents. Additionally, note is made of this inventor's application Ser. No. 07/508,312 entitled "Elevator Dynamic Channeling Dispatching for Up-Peak Period" filed on Apr. 12, 1990, Ser. No. 07/508,313 entitled "Elevator Dynamic Channeling Dispatching Optimized Based on Car Capacity" filed on Apr. 12, 1990, and Ser. No. 07/508,318 entitled "Elevator Dynamic Channeling Dispatching Optimized Based on Population Density of the Channel" filed on Apr. 12, 1990.

Dynamic channeling provides a way of balancing the building traffic density evenly among the elevator cars in a building. In channeling generally, the floors above the main floor or lobby are grouped into sectors, with each sector consisting of a set of contiguous floors and with each sector assigned to a car, with such an approach being used during up-peak conditions. For dynamic channeling, rather than merely assigning an equal number of floors to each sector, prediction methodology is used for estimating the future traffic flow levels for the various floors every short time interval, for example, every five (5) minutes based on past events or traffic conditions. These traffic predictors are then used to more intelligently and dynamically assign the floors to more appropriately configured sectors, having possibly varying numbers of floors to optimize the effects of up-peak channeling.

Thus, a modern day, computerized elevator system for an office building continuously monitors and records elevator-related, significant events occurring in the building, preferably for every minute or short interval of the day, at least during the normal business day, and every day of the year, at least for every business day. Based on the data resulting from the building's elevator usage, a series of predictions are performed to estimate the traffic density during the next few upcoming intervals, each of which intervals usually is a relatively short period of time, typically of the order of some few minutes, e.g., as noted above, five (5) minutes.

The predictions used are in turn based on two major factor types—"historic" and "real time" based prediction.

Historic prediction typically is done based on the information collected over the past several days relevant to the same instant or period of time. For example, at 9:15 AM, the historic prediction will predict the traffic arrival count at the lobby for, for example, the next two (2) minute interval consisting of 9:15 AM to 9:17 AM. The prediction is based on the data that was collected and maintained during the same 9:15 AM to 9:17 AM interval on, for example, every regular business day, for the last several days, prior to the day of the prediction.

On the other hand, real time prediction is a prediction based on much more recent data collected over a sufficiently short period of time, usually involving some minutes, to effectively be considered "real time" for the time period for which the prediction is being made. It thus predicts traffic based on the events or data of only the past some minutes, rather than the past few days.

Depending on the number of intervals being "looked ahead" and the type of prediction(s) involved, typically a real time prediction uses a number (one or more) of the past intervals prior to the current interval. For example, at 9:15 AM, the real time prediction might use the data collected during the last three, five (5) minute intervals of, e.g., 9:00 AM to 9:05 AM, 9:05 AM to 9:10 AM, and 9:10 AM to 9:15 AM. Based on these three sets of collected data, the real time prediction predicts the expected traffic for the next five (5) minute interval in a way that matches or at least approximates the current traffic arrival curve.

Single exponential smoothing is preferably used in the historic based predictions, while linear exponential smoothing preferably is used in the real time predictions. These smoothing techniques are discussed in general (but not in any elevator context or in any context analogous thereto) in *Forecasting Methods and Applica-*

*tions* by Spyros Makridakis and Steven C. Wheelwright (John Wiley & Sons, Inc., 1978), particularly in Section 3.3: "Single Exponential Smoothing" and Section 3.6: "Linear Exponential Smoothing."

A linear combination of these two prediction factors, namely historic ($x_h$) and real time ($x_r$), with equal weight being given to the two factors, typically provides the final prediction to be used in having the elevator system initiate or terminate certain elevator dispatching schemes or operations, particularly the initiation and termination of up-peak channeling. This is described in some detail in, for example, the exemplary embodiment of the '311 patent, although variants other than equality of the factors is disclosed in the patent as being possible.

Thus, in accordance with the '311 patent's exemplary embodiment:

$$\text{Final Prediction } (X) = ax_h + bx_r$$

where "a" and "b" are weighing "constants," in which $a+b=1$ and preferably are equal to each other, namely, $a=b=0.5$.

This exemplary prediction methodology works perfectly if people keep up the same schedule every day of the week down to the second.

However, in reality, there sometimes will be relatively abnormal variations in people's behavior from day to day, producing passenger traffic shifts. Thus, for example, even though a person or a group of people usually come to work every day at 8:00 AM, some days they are late and some days they are early. This abnormal variance from normal behavior or pattern can produce some out of sync conditions, particularly on the days of the variances, using the previously disclosed, exemplary prediction methodology of the '311 patent, which is based on normal behavior or traffic patterns, which is what exists for most days. Hence, although the '311 patent provided a very substantial advance in the art, it can be further optimized under certain operating conditions.

Thus, if there are any such abnormal or unusual shifts in the traffic pattern from the historic pattern(s) in either direction, i.e., early or late arrival of the passengers from the predicted conditions or events, the prior standard methodology could cause on these some few "abnormal" days the initiation of up-peak channeling at a time not in sync with the actual traffic pattern and/or maintain such up-peak channeling beyond the need for such channeling.

For example, if the system expected the arrival of a group of people at 8:10 AM, historic prediction would start anticipating and tuning the system to the expected destination of the people in the group. However, if this group of people were late for some reason (e.g., a traffic accident or other traffic delay, etc.), causing a temporal shift, to a later time, the system effectively would be "unaware" of the variance.

Hence, even though the real time prediction was then showing, for example, a traffic density of zero, the historic prediction factor would still affect the dynamic channeling to accommodate the historically expected group. However, since in fact there were no people to be served under the postulated conditions, the system operation under those circumstances would not be operating as effectively and efficiently as possible, and a later start of up-peak channeling would be desirable under these circumstances.

Additionally, at the other, terminating end of the channeling time spectrum, further inaccurate predictions could occur when a significant group of people would arrive early with respect to their normal (historic) arrival time. This would introduce another significant temporal shift in time (in this instance to an earlier time) of the real passenger traffic in comparison to the final prediction, when it was based in significant part on the historic factor.

For example, if people on, e.g., floor "ten" of a building historically came to work every day from 7:52 AM to 8:03 AM in the past, then the historic prediction factor would expect and predict the same behavior for today. However, if in fact some, relatively few people changed their habits, permanently or temporarily, then the equally weighted, final prediction methodology could again be out of sync. So, if every one on floor "ten" is on the job by, for example, 7:59 AM, the preferred, exemplary methodology of, for example, the '311 patent did not immediately detect the change(s) and would continue predicting and giving some weight to floor "ten" in continuing to creating dynamic channel(s), even though in fact there was then on that day no further need to do so for that floor. Thus, an earlier finish or end of the up-peak channeling operation would be desirable under these particular circumstances.

It should be noted that, although the '311 patent discussed initially using equally the two prediction factors, it also discussed varying the relative weights to be given to them over time based on the following methodology. As noted in the '311 patent, as a general statement, the relative values of the two prediction factors could be selected in a way which would cause the two types of predictors to be relatively weighted in favor of one or the other, or given equal weight if the "constants" are equal, as desired.

However, the relative values for "a" and "b" preferably were determined as follows. When the up-peak period started, the initial final predictions preferably assumed that $a=b=0.5$, namely the factors were at least initially to be treated equally. Further predictions were then made at the end of each minute, using the past several minutes data for the real time prediction, as well as using the historic prediction data.

The final predicted data for, for example, six (6) minutes was compared against the actual observations at those minutes. If at least, for example, four observations were either positive or negative and the error was more than, for example, twenty (20%) percent of the combined predictions, then the values of "a" and "b" were adjusted. This adjustment was preferably made using a "look-up" table generated, for example, based on past experience and experimentation in such situations. The look-up table provided relative values, so that, when the error was large, the real time predictions were given increasingly more weight.

An exemplary, typical look-up table suggested in the '311 patent is presented below:

| ERROR | VALUES For a | VALUES For b |
|---|---|---|
| 20% | 0.40 | 0.60 |
| 30% | 0.33 | 0.67 |
| 40% | 0.25 | 0.75 |
| 50% | 0.15 | 0.85 |
| 60% | 0.00 | 1.00 |

These values were further described as typically varying from building to building and could be "learned" by the system by experimenting with different values and comparing the resulting combined prediction against the actual, so that, for example, the sum of the square of the error was minimized. Thus, the prediction factors "a" and "b" were adaptively controlled or selected.

However, in the above, detailed, "look-up table" example of the preferred embodiment(s) of the '311 patent, if there was a significant late arrival of enough people that otherwise would have been sufficient with that day's actual beginning traffic to initiate up-peak channeling based on the historic data, up-peak channeling would be initiated and dynamic channeling assignments made to the cars for at least six (6) minutes, even though, for example, no significant traffic had yet arrived justifying the initiation of dynamic channeling operation of the elevator system.

This situation, which might be termed "late arrival" from the standpoint of the delayed arrival of the passengers causing the abnormal traffic shift or "too early start" from the standpoint of the pattern being designed to start based on the normal traffic flow, is graphically illustrated in FIG. 2A and could actually delay the service for at least some of the passengers that had in fact arrived, depending on their destination floors and the specific car assignments made as to the assigned floors in the dynamic channeling algorithm.

A like delay in response time for the proper termination of the up-peak channeling operation could occur, if, for example, most, if not substantially all, of the people going to one or more of the floors had in fact arrived earlier than historically had occurred in the past, resulting in these floors still being considered as having traffic to be accommodated under the dynamic channeling algorithm in use, when in fact such was not the case. This situation, which might be termed an "early finish" from the standpoint of the relatively early arrival of the passengers causing the abnormal traffic shift or a "too late finish" from the standpoint of the pattern being designed to end based on the normal traffic flow, is graphically illustrated in FIG. 2B and again would be less than ideal under these specific, relative unique, somewhat abnormal circumstances.

Thus, although, the adaptive approach of the invention of the '311 patent represented a very significant advance in the art, it did not cover all possible variances and in particular did not immediately adjust the initiation and termination of dynamic channeling to fit the currently existing traffic conditions, resulting in less than total optimization under these particular unusual variances.

DISCLOSURE OF INVENTION

The present invention is designed to provide an alternative or supplemental adaptive methodology for further optimizing the prior methodology and compensating for these types of potential "out of sync" problems by monitoring more closely different aspects of the building's activities, particularly its population density aspects, and/or otherwise qualify the use of the historic prediction factor in making the final prediction. It accordingly fine tunes the operation of the elevator system and its algorithms to reduce some out of sync conditions which might arise due to abnormal conditions under the system's previous exemplary prediction methodology, in different optimizing ways, all as explained more fully below.

The present invention thus originated from the need to optimize elevator system performance using further optimizing peak car assignments procedures to compensate for certain abnormal types of variances in traffic patterns in connection with, for example, up-peak dynamic channeling or other up-peak or other peak car assignment schemes.

To prevent the "too early start" problem or variance alluded to above, i.e., to compensate for the abnormal "late start temporal shift", the system predictor related subsystem in the preferred embodiment of the invention monitors the real time prediction component, and a contingency or qualification is placed upon the use of historic predictions.

In accordance with the preferred methodology of the invention, the historic prediction component(s) ($x_h$) are not allowed to affect the overall or final prediction (X) until the start of a traffic pattern is indicated by the real time predictions ($x_r$). However, preferably, once the historic prediction factor is activated, it remains active until the end of the peak period.

This "threshold" qualifying prevents the historic prediction factor from affecting the initiating of the dynamic channeling procedure or other up-peak car assignment scheme when there is a significant traffic shift to a later time, from what otherwise would have been the first or initial portion of a "too early start" of dynamic channeling, particularly when there is in fact really no traffic to move.

To prevent the "late finish" problem or variance alluded to above, i.e., to compensate for the abnormal "early finish temporal shift, " the system predictor related subsystem in the preferred embodiment of the present invention preferably relies on the pertinent floor(s)' population data accumulated up to that day based on real time de-boarding and boarding count data. This data can be evolved for the system using, for example, the methodology of application Ser. No. 07/580,887 entitled "Floor Population Detection for an Elevator System" referred to above.

The floor's population is monitored and analyzed while, for example, up-peak dynamic channeling or some other up-peak elevator car assignment scheme is in operation, to determine if up-peak operation should be terminated.

Since the purpose of channeling is to take people to their destination more effectively, the need for the system's channeling or other assignment scheme is completed once everyone (or most everyone) has arrived at their respective destinations. Therefore, when the system detects an inconsistency between the real count and the predictions, the invention gives greater, if not total, weight to the real count.

The use of these two optimizers in the present invention significantly improves the performance of the dynamic channel generation of the system by reducing out of sync conditions which otherwise might have occurred in the timing of the creation and termination times of dynamic channeling or other up-peak assignment scheme, thereby avoiding any too early starting or too late finishing of the scheme.

Although the particularly preferred application of the principles of the present invention is for the up-peak periods of time, these principles with some modification can also be applied to other peak periods, such as, for example, the down-peak period.

Additionally, the principles of the invention can likewise be applied to other pertinent situations in which real and historic prediction factors are combined to make up a final or used prediction in an elevator system to vary car dispatching or assignments.

The invention may also be practiced in a wide variety of elevator systems, utilizing known technology, in the light of the teachings of the invention, which are discussed below in some further detail.

Other features and advantages will be apparent from the specification and claims and from the accompanying drawings, which illustrate an exemplary embodiment of the invention.

BEST MODE

First Exemplary Elevator Application

For the purposes of detailing a first, exemplary elevator system, reference is had to the disclosures of U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. Pat. No. 5,024,295 issued Jun. 18, 1992, as well as of the commonly owned U.S. Pat. No. 4,330,836 entitled "Elevator Cab Load Measuring System" of Donofrio & Games issued May 18, 1982, the disclosures of which are incorporated herein by reference.

One application for the present invention is in an elevator control system employing microprocessor-based group and car controllers using signal processing means, which through generated signals communicates with the cars of the elevator system to determine the conditions of the cars and responds to, for example, hall calls registered at a plurality of landings in the building serviced by the cars under the control of the group and car controllers, to provide, for example, assignments of the hall calls to the cars, or, during up-peak conditions assigning the cars to various floor sectors using, for example, dynamic channeling in which the assignment is based at least in part on combined prediction values including real time and historic data. An exemplary elevator system with an exemplary group controller and associated car controllers (in block diagram form) are illustrated in FIGS. 1 and 2, respectively, of the '381 patent and described in detail therein, as well as in some of the related applications referred to above.

The makeup of micro-computer systems, such as may be used in the implementation of the elevator car controllers, the group controller, and the cab controllers can be selected from readily available components or families thereof, in accordance with known technology as described in various commercial and technical publications. The microcomputer for the group controller typically will have appropriate input and output (I/O) channels, an appropriate address, data and control buss and sufficient random access memory (RAM) and appropriate read-only memory (ROM), as well as other associated circuitry, as is well known to those of skill in the art. The software structures for implementing the present invention, and the peripheral features which are disclosed herein, may be organized in a wide variety of fashions.

Additionally, for further example, the invention could be implemented in connection with the advanced dispatcher subsystem (ADSS) and the operational control subsystems (OCSSs) and their related subsystems of the ring communication system of FIG. 1 hereof as described below.

Figure 1:
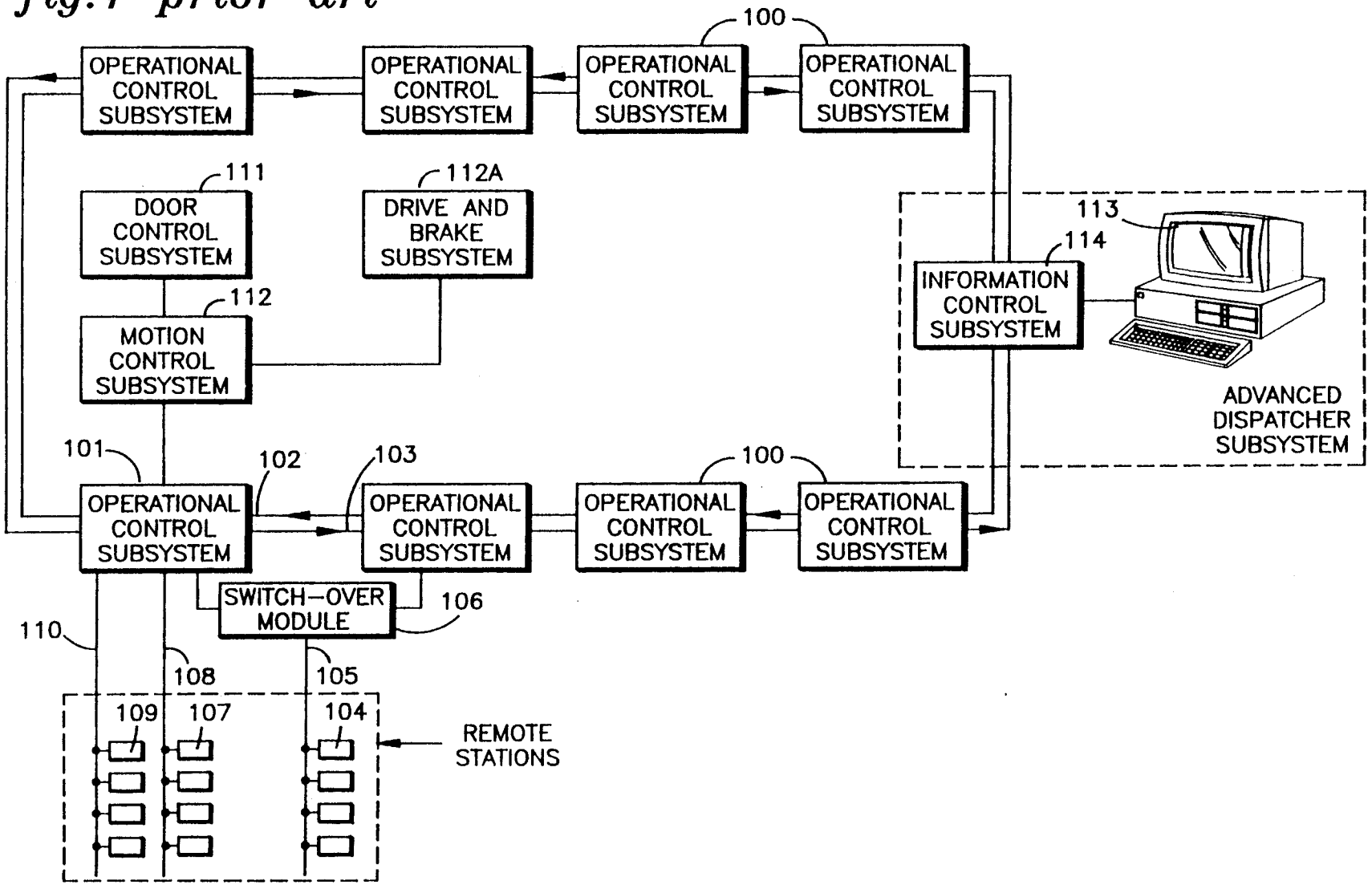
fig. 1 prior art
FIG. 1 is a simplified, schematic block diagram of an exemplary ring communication system for elevator group control employed in connection with the elevator car elements of an elevator system and in which the invention may be implemented in connection with the advanced dispatcher subsystem (ADSS) and the cars' individual operational control subsystems (OCSS) and their related subsystems.

Examplary Ring System (FIG. 1)

As a variant to the group controller elements of the system generally described above and as a more current application, in certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed to separate microprocessors, one per car. These microprocessors, known as operational control subsystems (OCSS) 100, 101, are all connected together in a two-way ring communication (102, 103). Each OCSS 100, 101 has a number of other subsystems and signaling devices 104–112A, etc., associated with it, as is described more fully below, but basically only one such collection of subsystems and signaling devices is illustrated in FIG. 1 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load measurement is sent to the motion control subsystem (MCSS) 112, which is also part of the car controller. This load measurement in turn is sent to the OCSS 101. DCSS 111 and MCSS 112 are micro-processors controlling door operation and car motion under the control of the OCSS 101, with the MCSS 112 working in conjunction with the drive and brake subsystem (DBSS) 112A.

The dispatching function is executed by the OCSS 100, under the control of the advanced dispatcher subsystem (ADSS) 113, which communicates with each OCSS 101 via the information control subsystem (ICSS) 114. The car load measured may be converted into boarding and de-boarding passenger counts using the average weight of a passenger by the MCSS 112 and sent to the OCSS 101. The OCSS sends this data to the ADSS 113 via ICSS 114.

The ADSS 113 through signal processing inter alia collects the passenger boarding and de-boarding counts at the various floors and car arrival and departure counts, so that, in accordance with its programming, it can analyze the traffic conditions at each floor, as described below. The ADSS 113 can also collect other data for use in making predictions, etc., if so desired.

For further background information reference is also had to the magazine article entitled "Intelligent Elevator Dispatching Systems" of Nader Kameli and Kandasamy Thangavelu (*AI Expert*, September 1989; pp. 32–37), the disclosure of which is also incorporated herein by reference.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicates for each car the car's load. Alternatively, passenger sensors, which sense the number of passengers passing through each elevator's doors, using for example, infrared sensors, can be used to get car boarding and de-boarding counts for car stop at floors other than the lobby and for each combined car arrival and departure at the lobby.

Using such data and correlating it with the floor involved and, if so desired, the time of day and preferably the day of the week, a meaningful, historically based, building and floor population or traffic measures can be obtained on a floor-by-floor basis based on boarding and de-boarding counts by using appropriate signal processing routines.

Figure 3:
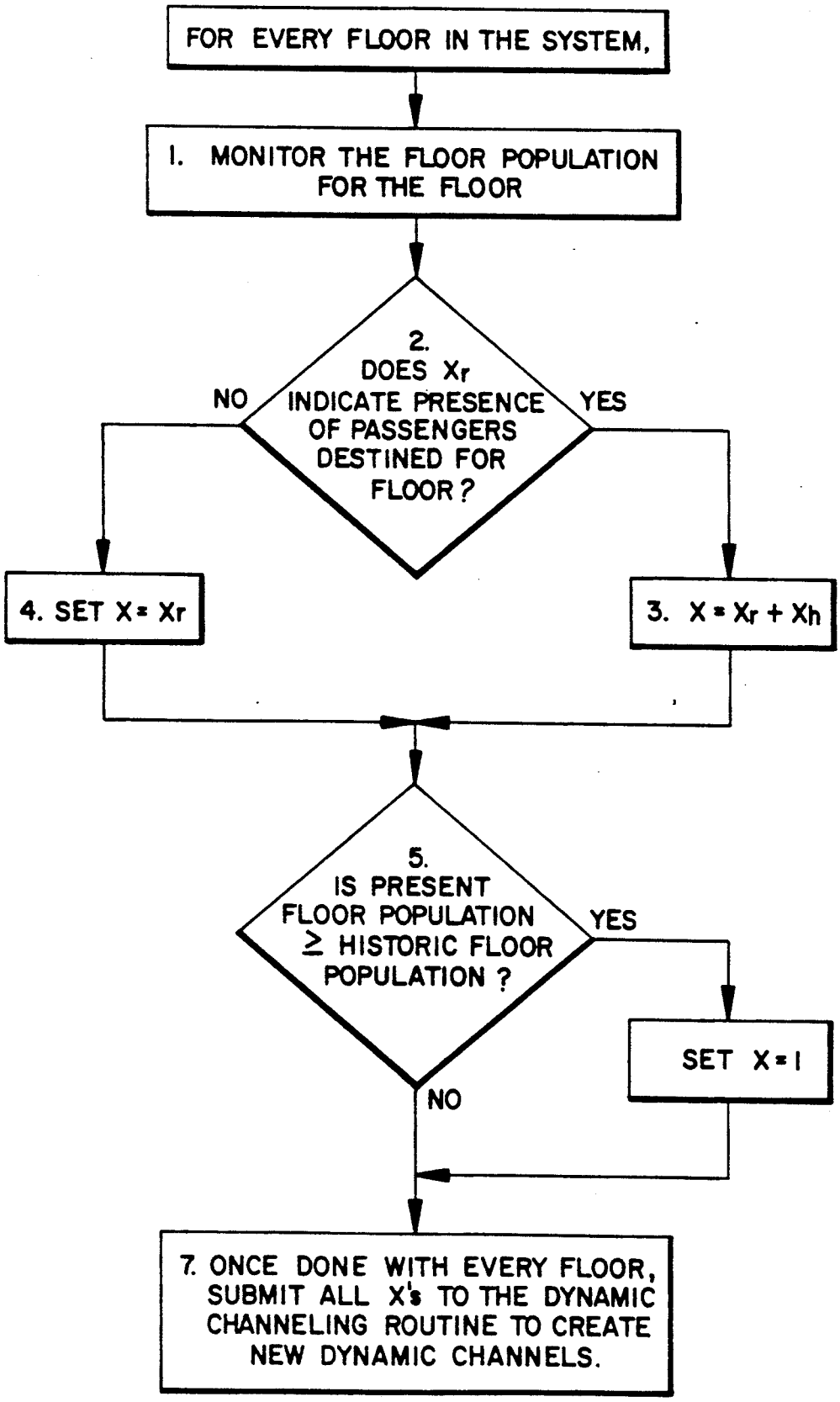
FIG. 3 is a simplified, logic flow chart or diagram of an exemplary algorithm for the methodology of the present invention used to compensate for passenger traffic shifts in association with prediction based, dynamic channeling for up-peak periods when either an "early start" or a "late finish" of up peak operation would have occurred but for the use of the invention.

Exemplary Algorithm for Compensating for Traffic Shifts (FIG. 3)

As generally illustrated in FIG. 3, the logic of the present invention provides exemplary techniques or methodology for preventing:

a "too early" implementation of dynamic channeling for the up-peak period, which would occur if there was a "later start" traffic shift, i.e., one in which the people which normally come during the beginning of the up-peak period come in late, as well as a "too late" continuation of the dynamic channeling scheme after the up-peak period has been at least partially completed, i.e., for at least one or more of the floors, which would occur if there was an "early finish" traffic shift, i.e., in which most, if not all, of the passengers for those floors came in earlier than usual.

The exemplary algorithm of FIG. 3 will be separately discussed in connection with those two types of variances in the context of dynamic channeling. However, it should be understood that the invention can be applied to other forms of up-peak car assignment schemes and to schemes for other peak periods.

Figure 2A:
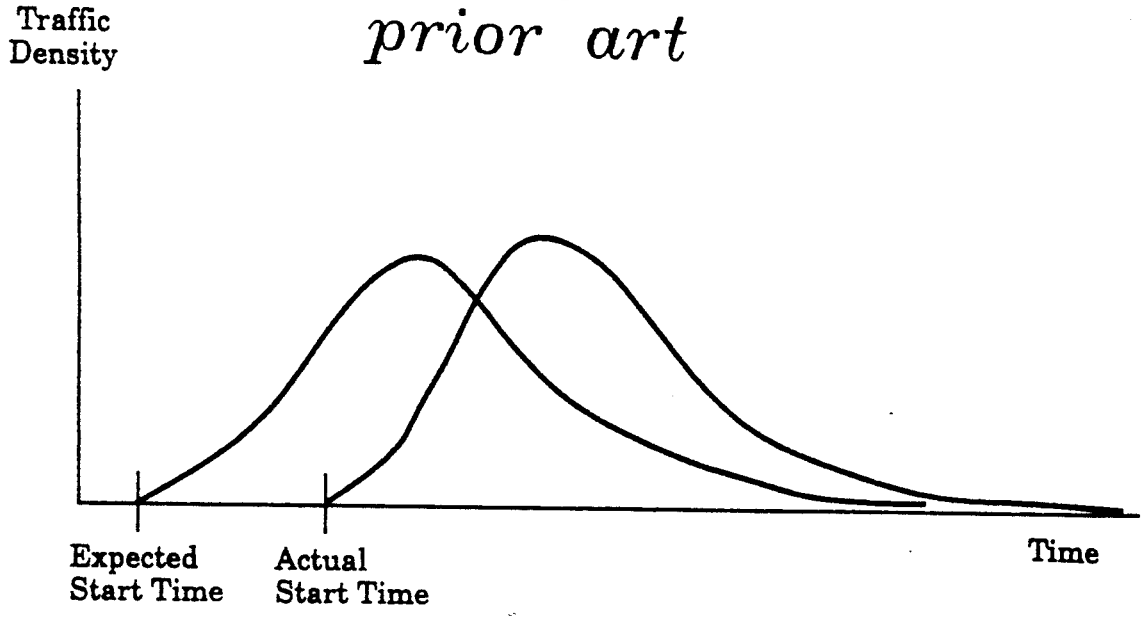
FIG.2A prior art
FIG. 2A is a graph of passenger traffic density vs. time comparing the actual passenger data to the predicted or expected data using the prediction methodology of the prior art, in which the prediction methodology would produce a "too early start" of the dynamic channeling of the elevator cars in association with the up-peak period due to an abnormal "late arriving" passenger traffic shift with passengers arriving later than normal, making it desirably to compensate for this unusual "late start temporal shift pattern" for maximized optimization of this aspect of system service.

"Later Start" Traffic Shift (FIG. 2A)

To prevent the "too early start" problem or variance alluded to above (note FIG. 2A), the system predictor monitors the prediction of both the historic and real time types. In the preferred embodiment of the invention a contingency or qualification is placed upon the use of historic predictions.

In accordance with the preferred methodology of the invention, historic predictions ($x_h$) are not allowed to affect the overall or final prediction (X) until the start of a traffic pattern is indicated by the real time predictions ($x_r$). However, preferably, once the historic prediction factor is activated, it remains active until the end of the peak traffic pattern is indicated.

This "threshold" qualifying prevents the historic prediction factor from affecting the initiating of the dynamic channeling procedure or other up-peak car assignment scheme when there is a significant traffic shift to a later time, from what otherwise would have been the first or initial portion of a "too early start" of dynamic channeling, particularly when there is in fact really no traffic to move.

Figure 2B:
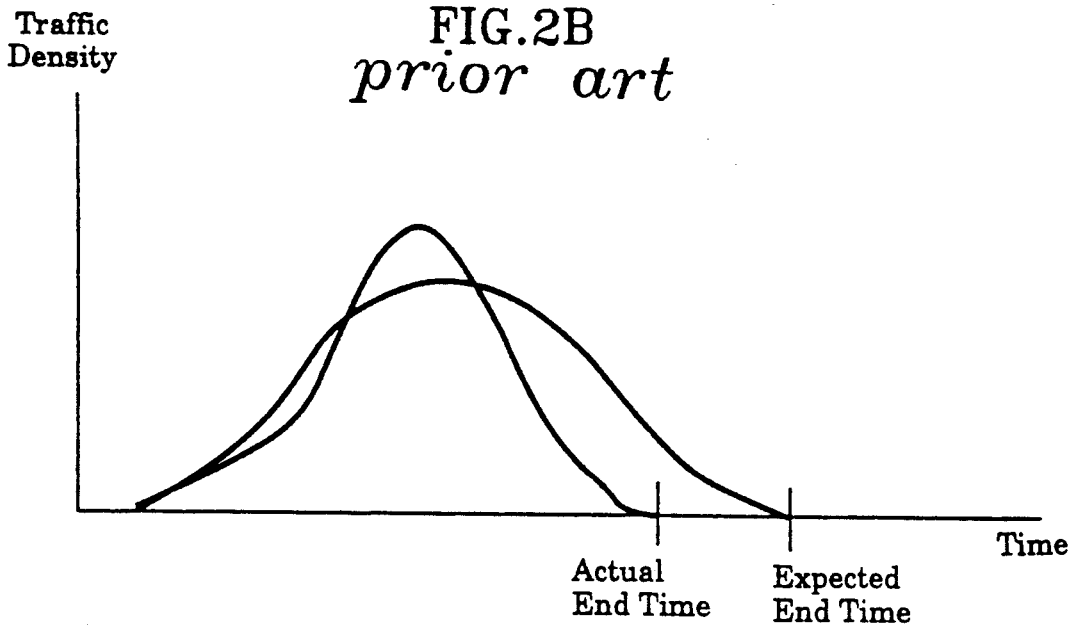
FIG.2B prior art
FIG. 2B is another graph of passenger traffic density vs. time comparing the actual passenger data to the predicted data using the prediction methodology of the prior art, similar to FIG. 2A, but in which the prediction methodology would produce a "too late end" of the dynamic channeling of the elevator cars in association with the up-peak period due to an "early arriving" passenger traffic shift with passengers arriving earlier than normal, making it desirable to compensate for this unusual "early finish temporal shift pattern" for maximized optimization of this aspect of system service.

"Earlier Finish" Traffic Shift (FIG. 2B)

To also prevent the "late finish" problem or variance alluded to above (note FIG. 2B), the system predictor preferably relies on the pertinent floor(s)' population data accumulated prior to that day, which is monitored and analyzed while, for example, up-peak dynamic channeling scheme is in operation, to determine if the channeling scheme should be terminated or be altered in part before the historic data would indicate such would be appropriate.

Since the purpose of channeling is to take people to their destination more effectively, the need for the system's channeling scheme is completed once every one (or most everyone) has arrived at their respective destination. Therefore, in the algorithm, when the system detects an inconsistency between the real count and the predictions, the greater, if not total, weight is given to the real count.

For example, if a floor population has a total population of one hundred and twenty (125) people, and this population density has stayed the same during the past few days, then it is reasonable and logical to assume that the expected number of people arriving at this particular floor will remain the same. As a further example, if after the first few minutes the system has counted up a total of "125" people as having arrived at that floor, but the prediction indicates during the next interval the floor is expected to receive an additional twelve (12) people, the system has a contradiction or an inconsistency in its data.

Since real data is used for the current floor density, the prediction may be discounted. This is done by inactivating the effect of that floor in the dynamic channel creation process. In other words, instead of giving that a higher priority due to the expected or predicted twelve people, it is given a normal "priority" or status for only one (1) person arriving. Thus this floor, like all the other floors, will receive service, but it will be regular service and not high priority service. This allows greater emphasis or higher priority service to be given to the other floors in which the pre-determined floor populations have not yet been satisfied.

The algorithm of FIG. 3 summarizes the above procedures and considerations as follows.

For every floor in the system, in step 1 the floor population for the floor is monitored. Additionally, the real time prediction component ($x_r$) of deboarding counts at each floor (as in said '311 patent) is evaluated.

In step 2, if the real time component indicates the presence of passengers destined for this floor, in step 3 the standard prediction methodology is used which combines the historic prediction component ($x_h$) with the real time component to determine the "final" prediction value (X). On the other hand, if no such indication is present, in step 4, the "final" prediction value (X) is set equal to the real time prediction component.

In step 5, if the currently calculated floor population for that floor is greater than or equal to ($\geqq$) the historic based floor population, that indicates that all passengers destined for that floor during up-peak have already arrived at that floor, and the value of "X" assigned to that floor is a nominal "1". Step 7 is then executed. On the other hand, if step 5 shows that the currently calculated floor population has not yet reached the historic based floor population, the sub-routine has been completed, and step 7 is executed. In step 7, once the process has been completed for every floor, all of the values of "X" are submitted to the dynamic channel routine to create new, updated channels for the floors.

Floor Population Spread Data

Since population density or spread data based on real time data is used in the invention, some understanding and discussion of this aspect of the elevator system is desirable for the complete understanding of the present invention. However, it should be understood that the methodology for pre-determining a building's floor population spread is not directly part of the present invention, and any appropriate methodology, particularly one that uses real time data such, as for example, de-boarding and boarding counts, can be used in this respect.

In addition to monitoring the arrival count of the people and their destinations in up-peak operation, the system of the invention also preferably monitors the building's total population density, as well as each floor's population. During the first few days (referred to as the system's "learning" period), the system learns the building density by counting up the number of people entering the building during the "up-peak" period, which is typically the morning arrival period of the office building's inhabitants, using, for example, the technology of application Ser. No. 07/580,882 entitled "Floor Population Detection for an Elevator System" referred to above.

Once the up-peak period (as it is defined in the system) is over, the system preferably compares the total accumulated for the day against the ones collected from the previous days. It then corrects the accumulated sum based on the value collected. Thus, today's count of density has only a limited weight in relation to the accumulated sum.

This approach prevents any one day's irregular count from drastically altering the actual sum.

This learning method is designed so that, if there is a shift in population density and the shift persists for, for example, ten (10) days, the accumulated population sum will completely reflect it. In other words, each day has only (in the ten day example) a ten (10%) percent affect in the accumulated sum "learned" thus far. But if it continues, the accumulated sum over time "permanently" adopts the population shift as the norm, until further population shift(s) need to be accommodated.

This same type of methodology preferably is applied to learning and cumulatively adjusting the population density for each floor.

In summary, during the up-peak period, each floor's population is computed by monitoring the boarding and de-boarding counts and using those counts to update that floor's population figure throughout that period on an additive bases. After the period has been completed, the floor-by-floor information, which had been maintained in a table, is used to determine the "final" historic based floor population spread using also historic data based at least on the past several active days' of population spread using "exponential smoothing." As a verifying cross-check the lobby's figure, which typically should equal the total building population, is compared to the total of all of the upper floors' populations.

The historically based derivation of the floor population is recorded on the hard disk of the microcomputer of the ADSS 113 and made available for use in other signal processing functions in the system, such as, for example, this invention's compensation of abnormal up-peak related traffic shifts, as well as for, prediction methodology for dynamic channeling of the elevator cars.

The use of these two optimizers in the present invention significantly improves the performance of the dynamic channel generation of the system by reducing the variances which would otherwise have occurred in the timing of the creation and termination times of dynamic channeling, thereby avoiding any too early starting or too late finishing of the scheme.

Although this invention has been shown and described with respect to at least one detailed, exemplary embodiment thereof, it should be understood by those skilled in the art that various changes in form, detail, methodology and/or approach may be made without departing from the spirit and scope of this invention.

I claim:

1. A method of dispatching a plurality of elevators serving a building, comprising:

in each of a large number of time periods in each working day— providing deboarding signals indicative of a count of all passengers arriving at each floor of the building;

providing boarding signals indicative of a count of all passengers departing from each floor of the building; and storing said deboarding and boarding signals for each floor per time period for a number of days;

providing for each floor a prediction factor signal which is a function of a real time arrival count indicated by the deboarding signals for each floor for the current period in response to such real time arrival count being insufficiently high, to indicate start of up-peak traffic for such floor, or alternatively providing said prediction factor signal for each floor which is a function of said real time arrival count and said historic arrival counts in response to such real time arrival count being sufficiently high, to indicate start of up-peak traffic for such floor; and dispatching elevators in said building in accordance with a method which utilizes said prediction factor signals.

2. A method of dispatching a plurality of elevators serving a building, comprising:

in each of a large number of time periods in each working day— providing deboarding signals indicative of a count of all passengers arriving at each floor of the building;

providing boarding signals indicative of a count of all passengers departing from each floor of the building;

storing said deboarding and boarding signals for each floor per time period for a number of days; and providing, in response to said deboarding signals and said boarding signals for each floor, population signals indicative of the population of each floor at the end of the related time period;

providing for each floor a prediction factor signal which is a function of a count indicating a single passenger departing such floor in response to said population signal for such floor in a current time period indicating the present population of such floor being equal to or greater than the historic population for such floor indicated by said population signals for the past several days; and dispatching elevators in said building in accordance with a method which utilizes said prediction factor signals.

3. A method of dispatching a plurality of elevators serving a building, comprising:

in each of a large number of time periods in each working day— providing deboarding signals indicative of a count of all passengers arriving at each floor of the building;

providing boarding signals indicative of a count of all passengers departing from each floor of the building;

storing said deboarding and boarding signals for each floor per time period for a number of days; and providing, in response to said deboarding signals and said boarding signals for each floor, population signals indicative of the population of each floor at the end of the related time period;

providing for each floor a prediction factor signal which is a function of a real time arrival count indicated by the deboarding signals for each floor for the current period in response to such real time count being insufficiently high, to indicate start of up-peak traffic for such floor, or alternatively providing said prediction factor signal for each floor which is a function of said real time arrival count and said historic arrival counts in response to such real time count being sufficiently high, to indicate start of up-peak traffic for such floor;

changing said prediction factor signal for each floor to one which is a function of a count indicating a single passenger departing such floor in response to said population signal for such floor in a current time period indicating the present population of such floor being equal to or greater than the historic population for such floor indicated by said population signals for the past several days; and dispatching elevators in said building in accordance with a method which utilizes said prediction factor signals.

* * * * *